US007825311B1

(12) United States Patent
Williams

(10) Patent No.: US 7,825,311 B1
(45) **Date of Patent: *Nov. 2, 2010**

(54) KEYBOARD GUITAR MUSICAL INSTRUMENT APPARATUS

(76) Inventor: Vinson Williams, 2205 Carleton Pl., Fort Smith, AR (US) 72917

( * ) Notice: Subject to any disclaimer, the term of this patent is extended or adjusted under 35 U.S.C. 154(b) by 621 days.

This patent is subject to a terminal disclaimer.

(21) Appl. No.: 11/436,046

(22) Filed: May 17, 2006

Related U.S. Application Data

(63) Continuation-in-part of application No. 10/761,539, filed on Jan. 16, 2004, now Pat. No. 7,075,001.

(51) Int. Cl.
*G10C 3/18* (2006.01)

(52) U.S. Cl. ..... 84/236

(58) Field of Classification Search ..... 84/267, 84/745, 423 R, 170, 442
See application file for complete search history.

(56) References Cited

U.S. PATENT DOCUMENTS

| | | | | |
|---|---|---|---|---|
| 522,048 | A | 6/1894 | Duvivier | |
| 726,084 | A | 4/1903 | Menze | |
| 778,882 | A | 1/1905 | Muller | |
| 1,040,232 | A | 10/1912 | Mecera | |
| 1,425,032 | A | 8/1922 | Milito | |
| 2,910,906 | A | 11/1959 | Della Libera | 84/170 |
| 4,091,702 | A | 5/1978 | Murakami | 84/1.16 |
| 4,336,734 | A * | 6/1982 | Polson | 84/646 |
| 5,596,157 | A | 1/1997 | Williams | 84/170 |
| 5,691,490 | A | 11/1997 | Williams | 84/170 |
| 6,111,179 | A | 8/2000 | Miller | 84/442 |
| 6,740,800 | B1 * | 5/2004 | Cunningham | 84/423 R |
| 7,075,001 | B2 | 7/2006 | Williams | 84/745 |
| 2007/0017356 | A1 * | 1/2007 | Nishida | 84/744 |

* cited by examiner

*Primary Examiner*—Kimberly R Lockett
(74) *Attorney, Agent, or Firm*—David B. Pieper; Keisling & Pieper PLC

(57) ABSTRACT

A musical instrument apparatus including multiple parallel strings defining a string line and a keyboard overlay positioned at an acute angle to the string line to allow for consistent playing feel by consistently positioning the hammers on the keys while allowing large key spacing with minimized distance between the strings. The hammers are directly mounted to the keys and are adapted to either cause vibration of the strings or clamp the strings against the upper surface of a neck board so that the strings may have multi tonal capabilities as is commonly used with a fret board neck on a guitar. The strings can be played with just the keyboard, but the strings also extend past an edge of the keyboard overlay so that the user can directly play the multiple parallel strings to achieve a guitar sound. Both an electrical pickup and an acoustical body are provided for further sound variety.

17 Claims, 10 Drawing Sheets

KEYBOARD GUITAR MUSICAL INSTRUMENT APPARATUS

CROSS-REFERENCE TO RELATED APPLICATIONS

This application claims priority to and is a continuation-in-part of U.S. patent application Ser. No. 10/761,539, filed Jan. 16, 2004 now U.S. Pat. No. 7,075,001.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to the field of musical instruments in general. In particular, the present invention relates specifically to a keyboard guitar shown as a musical instrument combining a chromatically scaled piano type keyboard angled across a guitar type string arrangement to achieve a unique instrument with new playing capabilities while achieving space efficiency with standard keyboard spacing. The keys are directly connected to hammers in a consistent manner and are arranged in a nonparallel manner to the strings to orient the hammers in a consistent position across the varying string lengths. This consistent hammer positioning enables consistent playing feel or action of the instrument and the extension of the strings past the keyboard overlay provides both the key playing and strumming capability on the same strings. In one method of playing, when the keys are depressed a hammer strikes the strings that makes the strings vibrate. Another aspect of the invention is the ability to press a key to act like a finger on a fret board such that the string vibrates at a different frequency which is combined with an extension of the strings allowing the user to strum, pluck, pick, and/or other wise play the strings to cause vibration. This provides a unique instrument arrangement with unique capabilities over the known art. In this manner, a musical instrument of new design is provided combining the chromatically scaled piano like keyboard and the guitar.

Known art may be found in U.S. Class 84, Music, Subclass 267, Guitars, Subclass 291, Bodies, and Subclass 423r Keyboards; along with Class 984 Musical Instruments, Subclass 157 for combinations of different musical instruments, and Subclass 212 for combinations of two or more instruments as well as in other classes and subclasses.

2. Description of the Known Art

For many years, pianos, harpsichords, clavichords and clavinets have produced musical sounds from a chromatic keyboard action. The keys when depressed strikes the strings of these types of instruments making the strings vibrate. All of these instruments have only this type of means of vibrating the strings.

The guitar, mandolin, violin, banjo and other stringed musical instruments have also been around for many years. These instruments produce their sounds by articulating the fingers on the finger board and picking, plucking, strumming and bowing the strings as the means of vibrating the strings.

As will be appreciated by those skilled in the art, a keyboard and/or a string may be used in various processes used to create a musical tone. Details of a typical combination of these basic elements are contained in: U.S. Pat. No. 522,048 issued to Duvivier on Jun. 26, 1894; U.S. Pat. No. 726,084 issued to Menze on Apr. 21, 1903; U.S. Pat. No. 778,882 issued to Muller on Jan. 3, 1905; U.S. Pat. No. 1,040,232 issued to Mecera on Oct. 1, 1912; U.S. Pat. No. 1,425,032 issued to Milito on Aug. 8, 1922; U.S. Pat. No. 2,910,906 issued to Libera on Jul. 1, 1957; U.S. Pat. No. 4,091,702 issued to Murakami on May 30, 1978; U.S. Pat. No. 5,596,157 issued to Williams on Jan. 21, 1997; U.S. Pat. No. 5,691,490 issued to Williams on Nov. 25, 1997; and U.S. Pat. No. 6,111,179 issued to Miller on Aug. 29, 2000. Each of these patents is hereby expressly incorporated by reference in their entirety. Several of these are worth additional discussion.

U.S. Pat. No. 522,048 issued to Duvivier on Jun. 26, 1894 discloses a moveable keyboard as in FIG. 3 having the keyboard in question placed upon its neck.

U.S. Pat. No. 1,040,232 issued to Mecera on Mar. 4, 1912 discloses an object of the invention to produce a zither or like musical instrument having an improved construction and arrangement of key operated means for striking the strings.

An additional patent for consideration is U.S. Pat. No. 5,691,490 issued to Williams on Nov. 25, 1997 which discloses a stringed musical instrument such as an electric or acoustic guitar and a bass guitar in combination with a piano-type keyboard.

Thus, it may be seen that these prior art patents are very limited in their teaching and utilization, and an improved combination string and keyboard instrument is needed to overcome these limitations.

SUMMARY OF THE INVENTION

The present invention is directed to improved musical instrument combining the chromatically scaled piano like keyboard angularly positioned in relation to a guitar type string board.

The keyboard guitar is like the keyboard action of the piano, harpsichord, clavichord and clavinet, in that it is a chromatic keyboard action. The keys when depressed strike the strings making the strings vibrate, however unlike these instruments this is not the only means of vibrating the strings. The keyboard guitar is also like the guitar, mandolin, violin, banjo and other stringed musical instruments in that it can be picked, plucked, strummed, and bowed as a means of vibrating the strings also, however unlike these instruments the finger board is replaced with the keyboard. The keyboard guitar has a sound and playing action of the guitar with all of its styles, sounds like, acoustic guitar, electric guitar, jazz guitar, rock guitar and metal guitar are all easy to play. The keyboard action makes it easy to play and the picked, plucked, strummed and bowed action make it authentic sounding. The player depress the keys which starts the strings vibrating and then holds the keys down while strumming the exposed strings to add rhythm to the song. The strings are amplified from electronic pick ups located near the strings to an external amp. A volume knob, tone knob, and switching network are the controls on the body of the keyboard guitar for a full range of tonal quality like the electric guitar. The instrument can also be acoustic if the body is built with a wood box resonator like the acoustic guitar. An all digital version of the keyboard guitar may also be manufactured with a virtual string pad for the strumming effect, drums and bass rhythm section and its own speakers similar to an electronic keyboard.

In accordance with one exemplary embodiment of the present invention, a musical instrument apparatus is provided including multiple parallel strings defining a string line and a keyboard overlay positioned at an acute angle to the string line to allow for consistent playing feel for the user. The consistent feel is achieved by consistently positioning the hammers on the keys while allowing large key spacing with minimized spacing distance between the strings. In the preferred embodiment, the hammers are directly mounted to the keys and are adapted to either cause vibration of the strings or clamp the strings against the upper surface of a neck board so that the strings may have multi tonal capabilities as is commonly used with a fret board neck on a guitar.

The strings can be played with just the keyboard, but the strings also extend past an edge of the keyboard overlay so that the user can directly play the multiple parallel strings to achieve a guitar sound. Both an electrical pickup and an acoustical body are provided for further sound variety.

Advantages of the present invention include: multiple tones and sounds for both keyboard and guitar type playing; simple construction, standardized playing feel for the user, as well as other advantages that will be apparent from the disclosed embodiment. These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
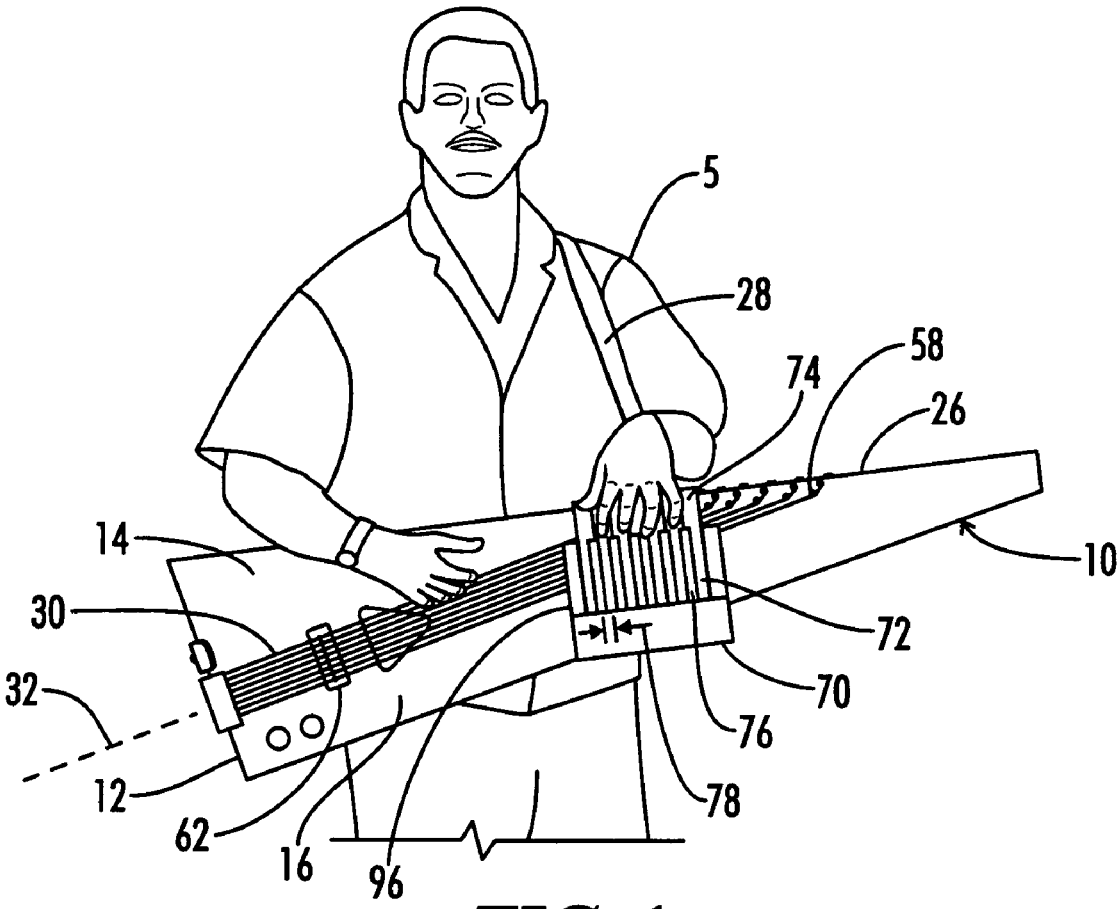
FIG. 1 is an isometric view of an exemplary embodiment of the present invention being played by a user.
Figure 9:
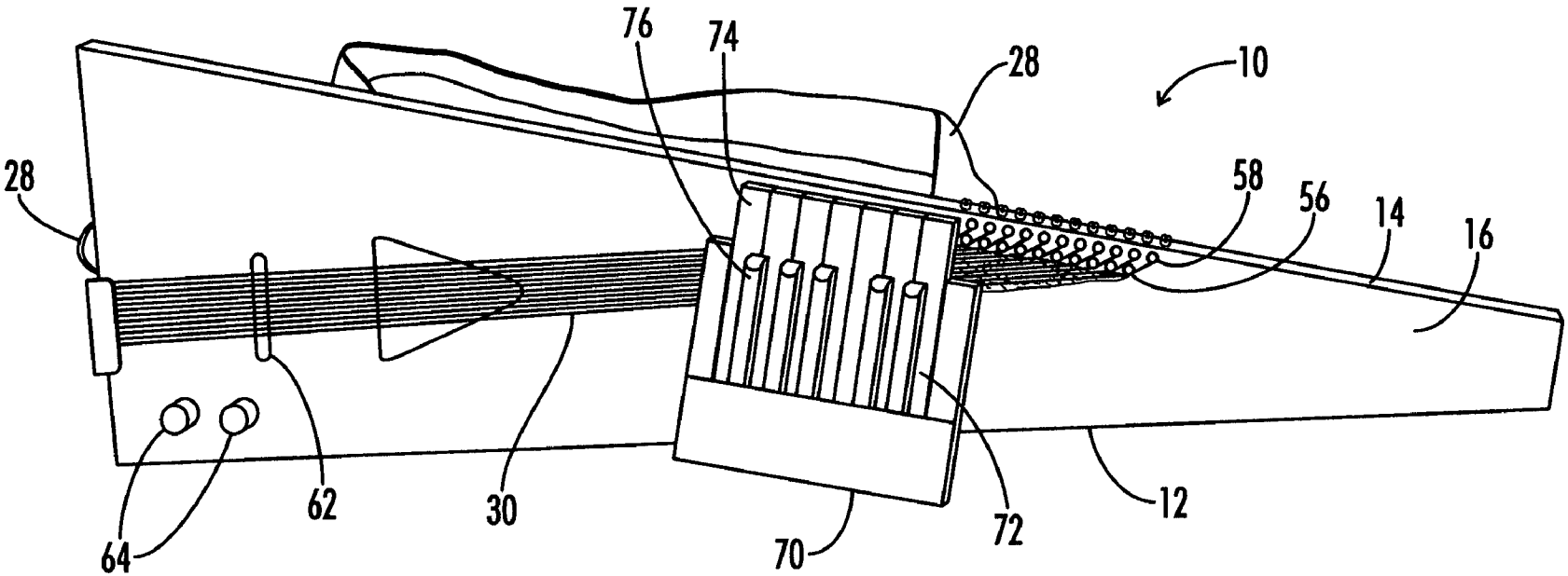
FIG. 9 is a top view of an embodiment of the present invention.

FIG. 1 is a perspective view and FIG. 9 is a top view of the keyboard guitar musical instrument apparatus 10 shown as exemplary embodiments of the present invention. In FIG. 1, the keyboard guitar musical instrument apparatus 10 is being played by a user 5 with the user's left hand illustrating the ability to play the instrument with the keys and the right hand further illustrating the ability of the user to directly contact the strings. This particular configuration is also useful for using a slide bar in combination with either hand playing of the strings or striking of the strings with the keyboard hammers to present an even further range of sounds.

As shown in FIGS. 1 and 9, the keyboard guitar musical instrument apparatus 10 includes a body 12 defining a hollow acoustic resonant area 14 with a front surface sound board 16 similar in principle to that used in an acoustic guitar. The multiple parallel strings 30 extend parallel to a string line 32 to the intonation rod 56 (see FIGS. 2-5, 8) and the adjustable tensioning cylinder 58 mounted on the nut mounting side 26 of the body 12. A strap 28 is mounted to the body 12 so that the keyboard guitar musical instrument apparatus 10 can be worn by the user 5 in a manner similar to that for a standard electric or acoustic guitar. Multiple pickups 62 are mounted on the body 12 with typical electronic controls 64 (see FIG. 7) such as volume, tone, switching network and effects that may be built into the electronics on the instrument 10. A standard cord connection 66 (see FIG. 7) is used for connection into an amplifier or other electronics. Note that it is envisioned that typical improvements may be made to the present device such as a tremolo device or other well known improvements.

FIGS. 1 and 9 also show the positioning of the keyboard overlay 70 mounting for keys 72 including a standard chromatic layout of white keys 74 and black keys 76 separated by the standard key separation distance 78. The multiple parallel strings 30 extend past an edge 96 of the keyboard overlay 70 to allow for strumming, picking, plucking, or otherwise playing the strings 30 directly.

Figure 2:
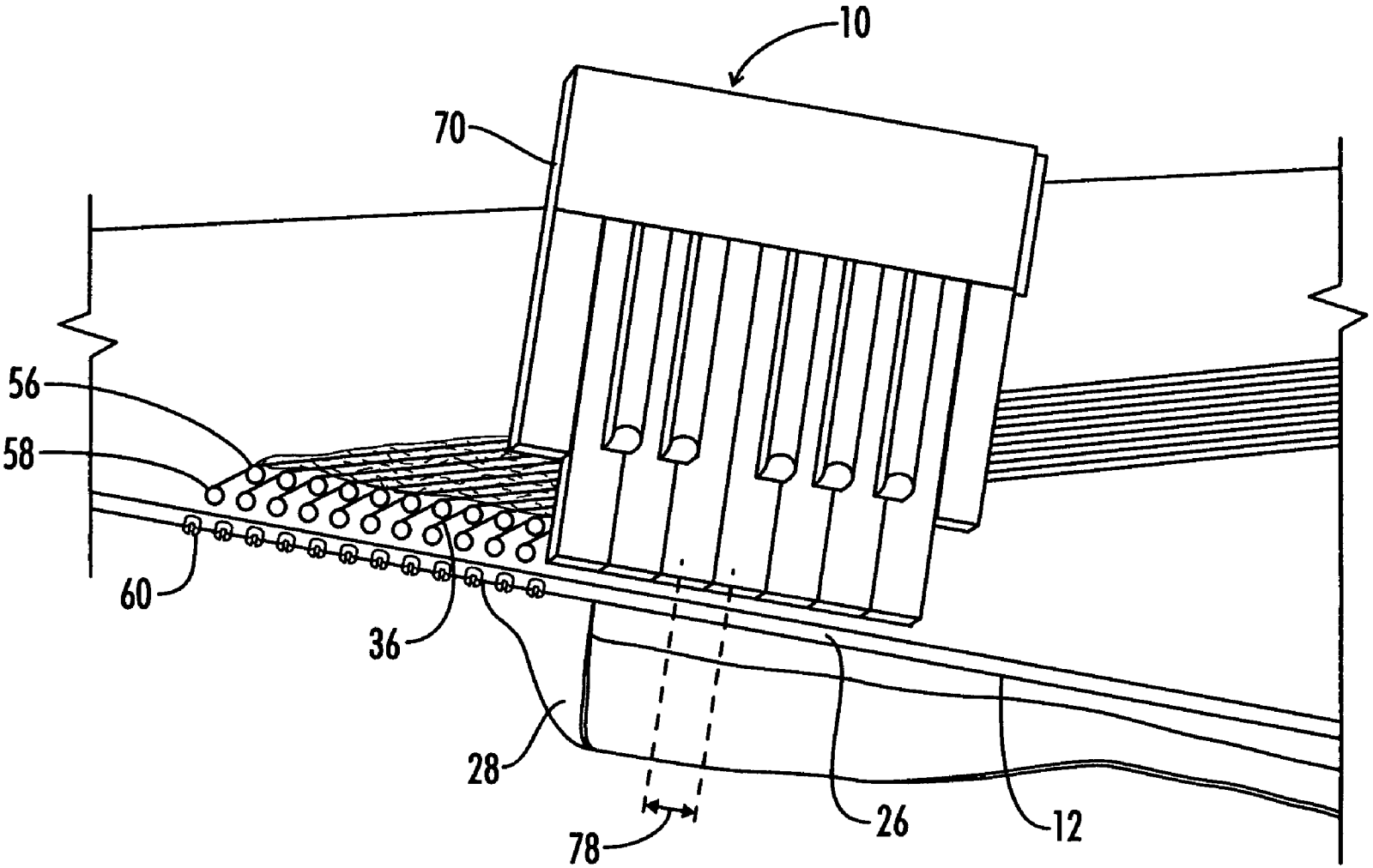
FIG. 2 is a partial head end view of the embodiment of FIG. 1.

FIG. 2 is a partial head end view of FIG. 1 showing the keyboard guitar musical instrument apparatus 10. The body 12 may be clearly seen with the intonation rod 56, adjustable tensioning cylinder 58, and tensioning head 60 visible on the nut mounting side 26. The intonation rod 56 sets the length of the string and redirects the string to its connection to the adjustable tensioning cylinder 58. Rotation of the adjustable tensioning cylinder 58 controls the tension on the string by wrapping the first string end 36 around the adjustable tensioning cylinder 58. Similar to a standard guitar head, the position of the adjustable tensioning cylinder 58 is controlled by rotation of the tensioning head 60 which is connected by a gear thread to the internal portion of the adjustable tensioning cylinder 58 as is well known in the art. FIG. 2 further shows the position of the keyboard overlay 70 and the key separation distance 78 is further shown for clarity.

Figure 3:
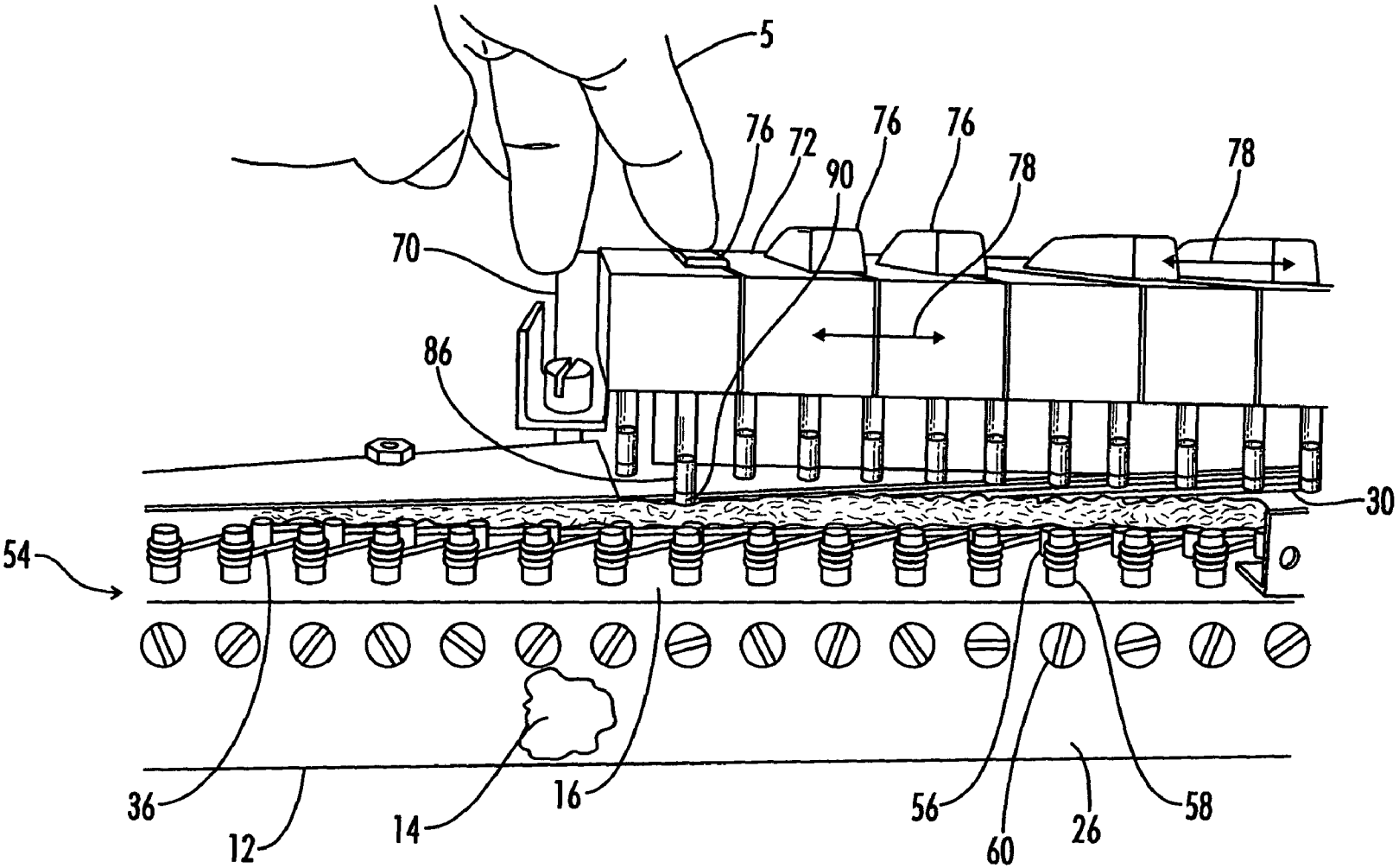
FIG. 3 is a partial nut mounting side view of the embodiment of FIG. 1.
Figure 10:
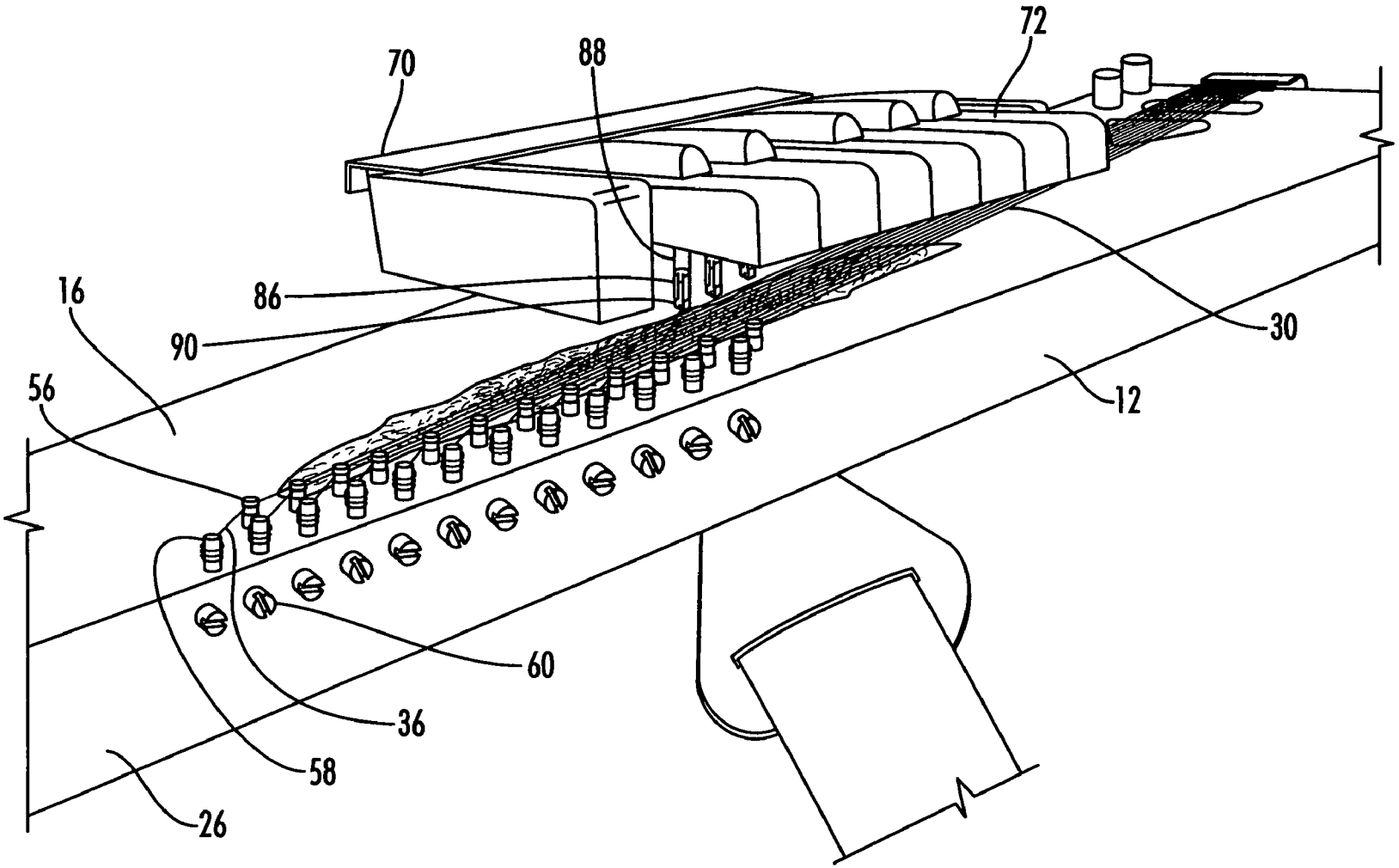
FIG. 10 is a partial nut mounting side view.

FIGS. 3 and 10 are a partial nut mounting side view of the embodiment of FIGS. 1 and 9. FIG. 3 shows the hand of the user 5 pressing a key 72 which shows the movement of the hammer 86 and hammer head 90 associated with the key 72. As illustrated in this cutout of this figure, the body 12 includes a hollow acoustic resonant area 14 with a front surface sound board 16 for mounting of the strings 30 for playing the instrument 10. The nut mounting side 26 is clearly visible with first string ends 36 connected at the side placement head 54 of the instrument across the intonation rod 56 to the adjustable tensioning cylinder 58 adjusted by the tensioning head 60. Each string 30 is connected in a similar manner with the intonation rod 56 positioning controlling the length of the string 30 from the bridge 48. The keyboard overlay 70 is indicated with the keys 72 showing a black key 76 being depressed. The key separation distance 78 is visible from this view for understanding of the standard keyboard spacing. The hammers 86 are clearly visible showing the hammer body 88 that is connected to the appropriate key 72 and the use of the hammer head 90 for contacting one of the strings 30. The linear relationship of the hammers 86 and the keys 72 may also be easily seen in this view. Note that one advantage of the present invention may be understood from this view by noting that a tremolo effect may be produced by varying the force on the keys to press the string harder and softer into the string to stretch the string in a varying amount to produce the effect much like a tremolo bar on a normal guitar.

Figure 4:
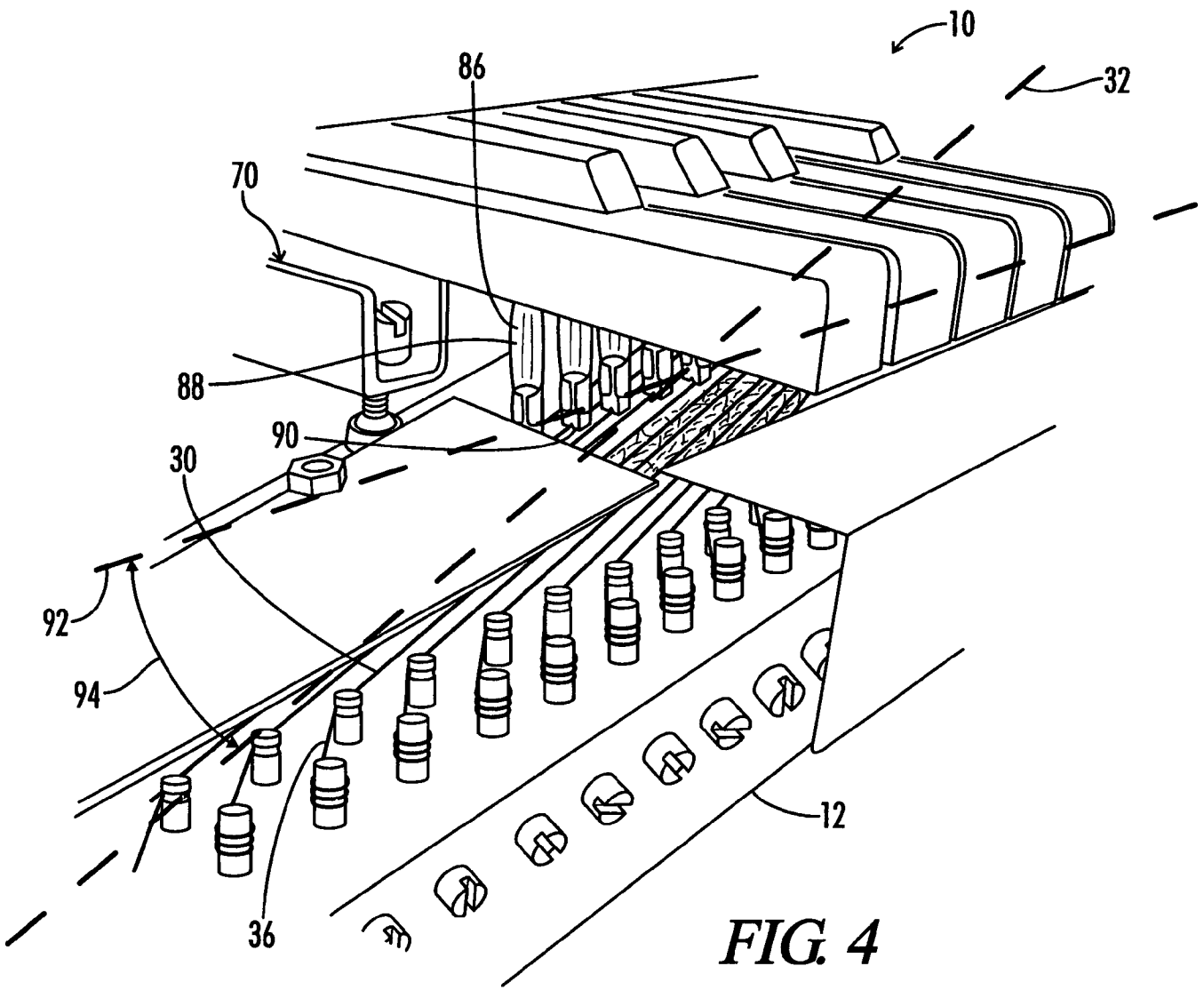
FIG. 4 is a partial perspective nut mounting side view of the embodiment of FIG. 1.

FIG. 4 is a partial perspective nut mounting side view of the keyboard guitar musical instrument apparatus 10. FIG. 4 shows the body 12 supporting the multiple parallel strings 30 along the string line 32 with the first string end 36 connected as previously described. Also shown is the keyboard overlay 70 as previously described with hammers 86 using a hammer body 88 to extend downward to a hammer head 90 for contacting the strings 30. As may be seen in this illustration, the hammers 86 are positioned in a hammer line 92 that is at an acute angle 94 to the string line 32. See FIG. 8 for further clarification of this advantage.

Figure 5:
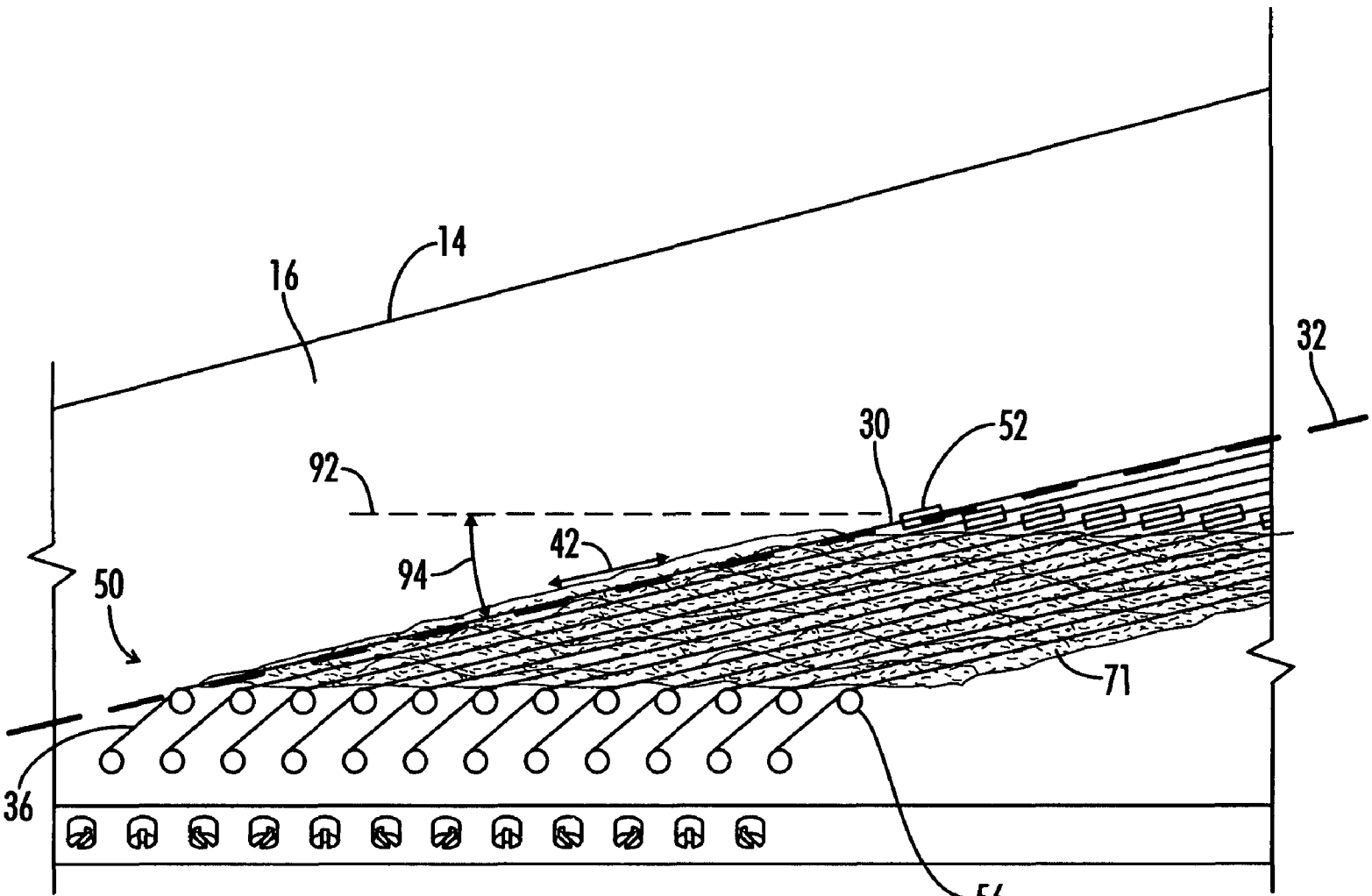
FIG. 5 is a partial perspective nut mounting side view with the keyboard overlay removed.

FIG. 5 is a partial perspective nut mounting side view of the multiple parallel strings 30 positioned along the string line 32 as shown with the keyboard overlay 70 removed. The strings 30 pass across the front surface sound board 16 of the hollow acoustic resonant area 14 and pass across the neck area 50 having a raised upper surface 52 which the hammer 86 presses the string 30 against. The first string end 36 is shown passing through dampening material 71, yarn interwoven into the strings, on its way to the to the intonation rod 56. In the preferred embodiment, the yarn is interwoven and braided with crossovers amongst the strings 30 to provide the dampening material 71. As shown, the string length 42 passes across the raised upper surface 52 such that when the hammer 86 presses these string 30 against the raised upper surface 52 a reduced string length 44 is achieved. The hammer 86 is not visible in FIG. 5. Note that the raised upper surfaces 52 are positioned under the location of the hammers 86 such that they are positioned on the hammer line 92 at an acute angle 94 to the string line 32.

Figure 6:
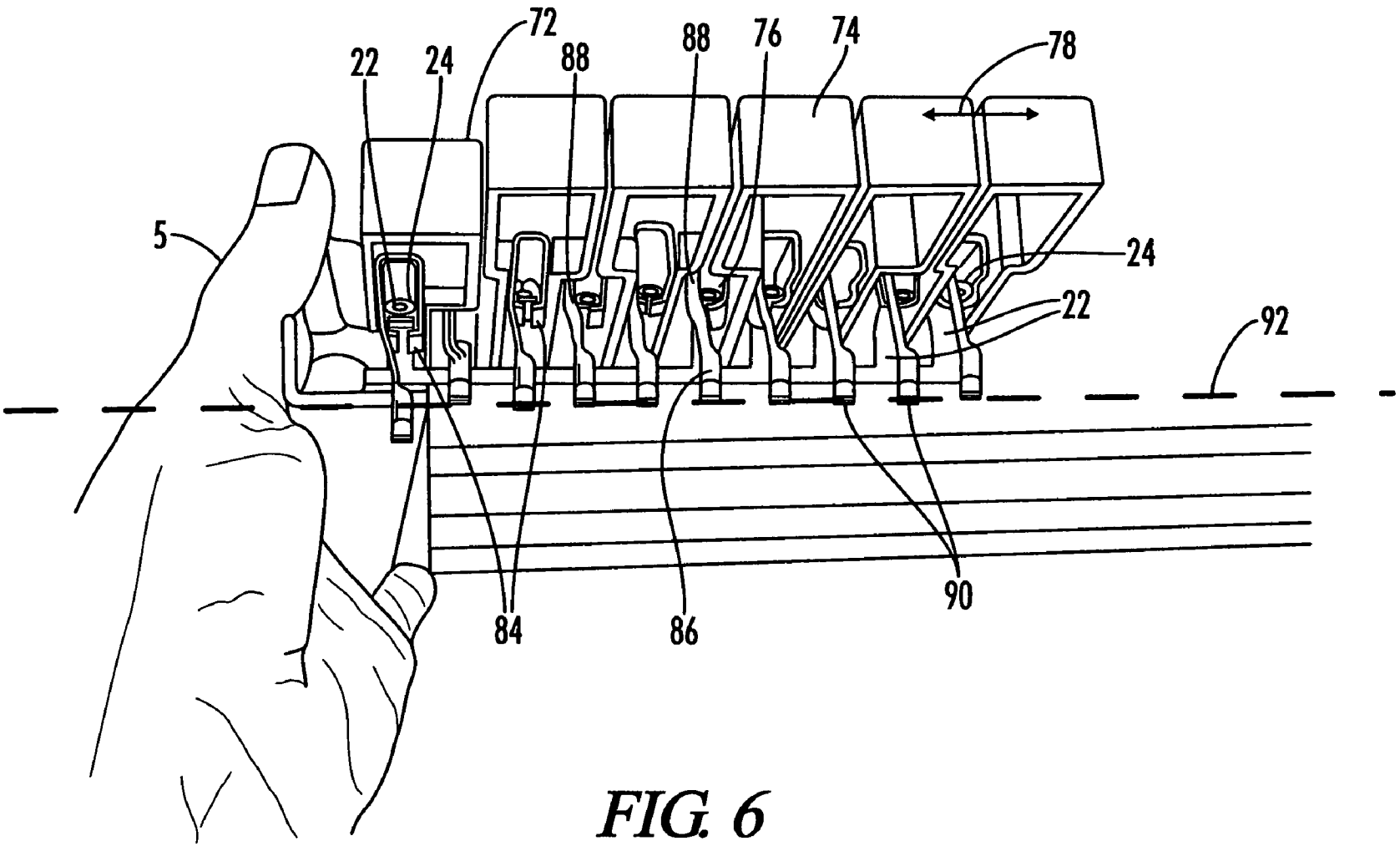
FIG. 6 is a partial underside view of the keyboard overlay.

FIG. 6 is a partial underside view of the keyboard overlay showing the user 5 depressing a key 72 such that the position of a key finger 22 and stop dampener 24 may be seen as they are used to catch the key stop 84 built in as part of the hammer body 88 to control the maximum upward movement of the keys 72. As shown, the keyboard overlay 70 includes keys 72 including white keys 74 and black keys 76 spaced at a key separation distance 78. Each key has a hammer 86 including a built in key stop 84 with a downwardly extending hammer body 88 holding a hammer head 90 for contacting the strings 30. The strings 30 are not visible in FIG. 6. The keys 72 and the associated hammers 86 are consistently lined up in the normal keyboard fashion with a consistent hammer line 92 along the keys 72 such that the keys 72 maintain a consistent playing feel.

Figure 7:
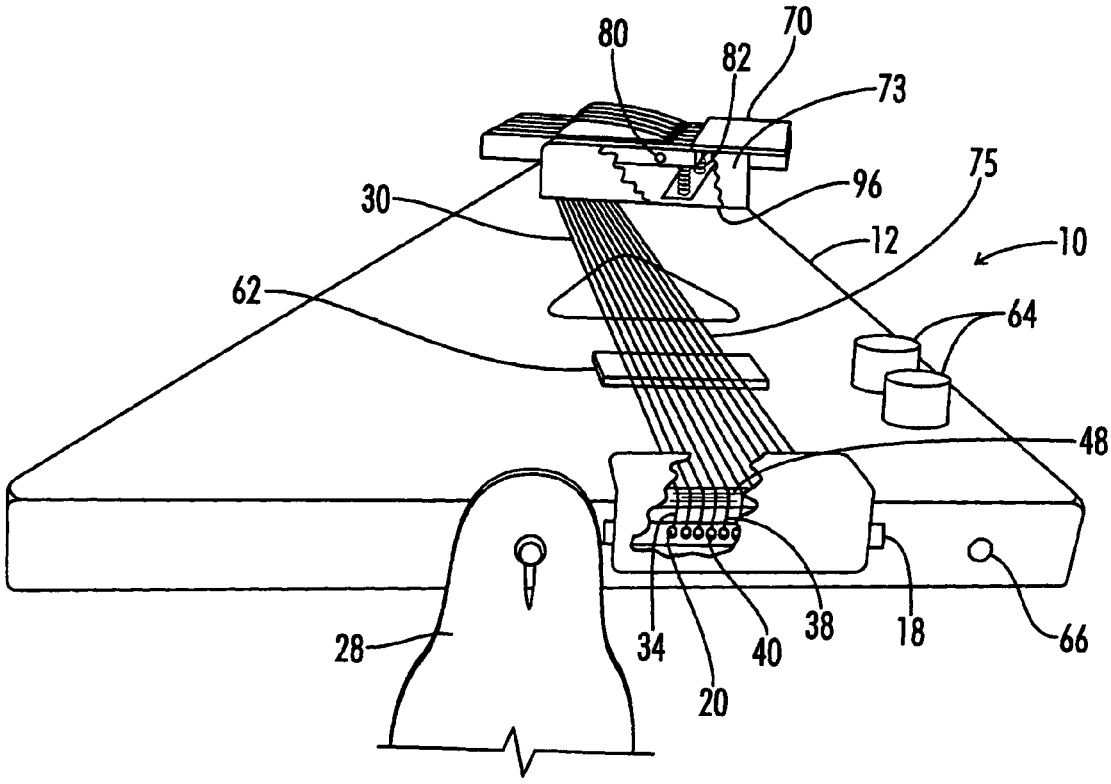
FIG. 7 is a partial bridge end view of the embodiment of FIG. 1.

FIG. 7 is a partial bridge end view of the keyboard guitar musical instrument apparatus 10. FIG. 7 shows the body 12 with string catch 18 supporting catch fingers 20. Each of the multiple parallel strings 30 is shown as an individual string 34 is mounted along the string line 32 with a second string end 38 having a loop 40 adapted to catch a catch finger 20. The string separation distance 46 may be seen from this view as the strings cross the bridge 48 that hold them above the neck area (hidden by overlay) and the upper surfaces (hidden by overlay) of the body 12.

FIG. 7 also clearly denotes the location of the pickup 62 and the electronic controls 64 and their associated electrical connection into the cord connection 66 as is well known on conventional guitars. Note that a tremolo device may be used on the present invention although one is not shown here due to the complexities of the present invention. The overlay support 73 of the keyboard overlay 70 above the body 12 is shown and the pivot connection 80 and biasing spring 82 may be seen for holding the key 72 in the rest position. As is shown, when the key 72 is depressed, it rotates around the pivot connection 80 and the spring 82 is stretched which biases the key 72 to the rest position. After the key is released, the spring 82 draws the key 72 on the pivot 80 to bring it back to the rest position. Also illustrated in FIG. 7 is the extension of the strings past the edge 96 of the keyboard overlay 70 which allows for a hand contact playing area 75 for the strumming of the strings 30.

Figure 8:
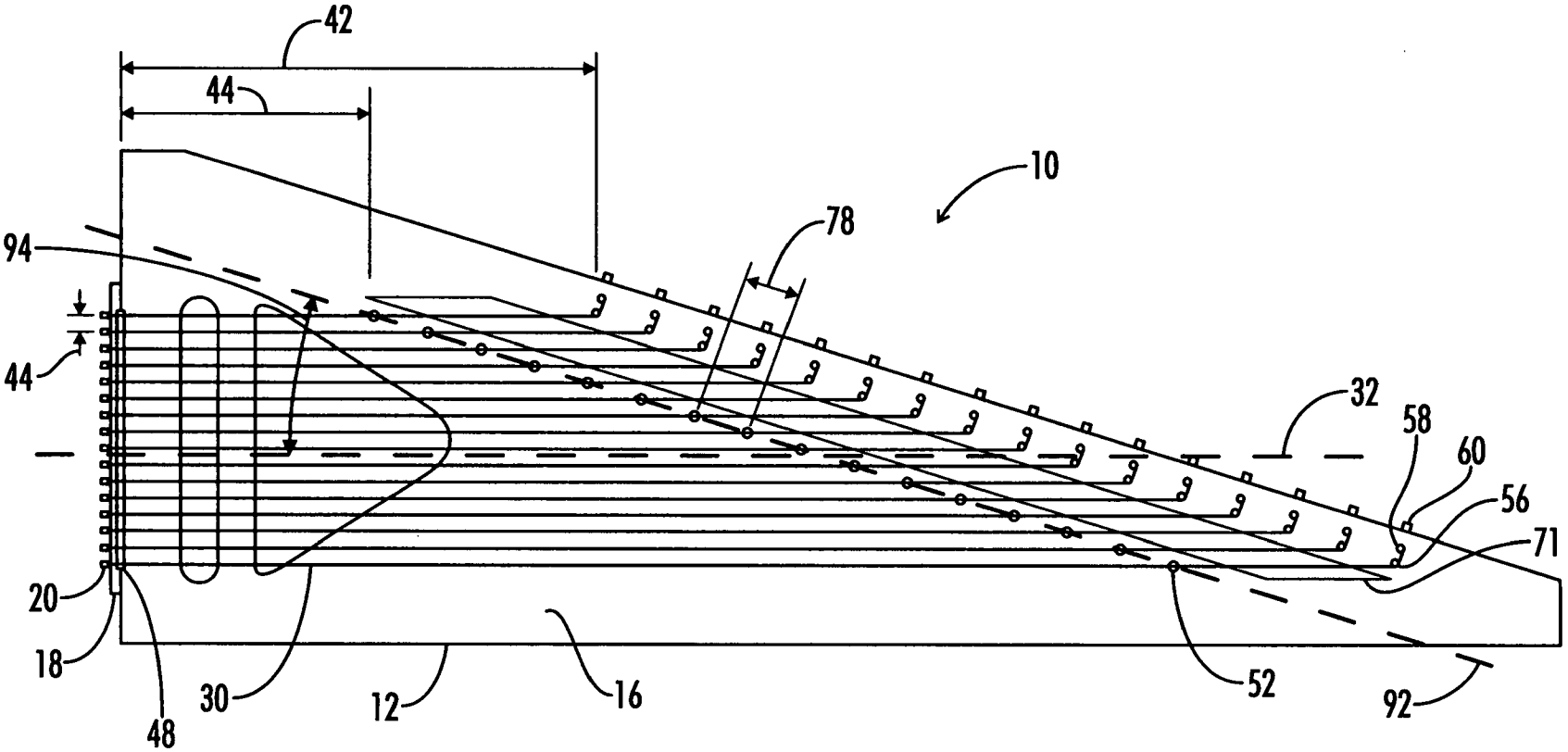
FIG. 8 is a schematic representation of the hammer line and string line orientation of the embodiment of FIG. 1.

FIG. 8 is a schematic representation of the hammer line and string line orientation of the keyboard guitar musical instrument apparatus 10. The body 12 is shown with the strings 30 positioned over the front surface sound board 16. The strings 30 extend along the string line 32. The strings 30 extend from the loop of the string positioned on the catch finger 20 of the string catch 18 across the bridge 48, above the upper surface 52, through the dampening material 71, to the intonation rod 56 and adjustable tensioning cylinder 58 adjusted by the tensioning head 60. In this manner, each string is defined with a string length 42 extending from the bridge to the intonation rod 56 which may be segmented by the hammers 86 (not shown) pressing the strings against the upper surfaces 52 to form a string with a reduced string length 44 extending from the upper surface to the bridge. As noted in this figure, the strings 30 are separated by a string separation distance 46 measured perpendicular to the string line 32 and the hammers are separated by the key separation distance 78 measured perpendicular from the hammer line 92. It may also be noted the string line 32 and the hammer line 92 intersect at an acute angle 94 which allows for the compact arrangement of the instrument while maintaining the key separation distance 78 commonly known by pianists.

Reference numbers used throughout the written specification and drawings are provided as follows:

User 5
Keyboard Guitar Musical Instrument Apparatus 10
Body 12
Hollow acoustic resonant area 14
Front surface sound board 16
String catch 18
Catch finger 20
Key finger 22
stop dampener 24
Nut mounting side 26
Strap 28
Multiple parallel strings 30
String line 32
String 34
First string end 36
Second string end 38
Loop 40
a string length 42
a reduced string length 44
a string separation distance 46
Bridge 48
Neck 50
Upper surface 52
Head 54
Intonation rod 56
Adjustable tensioning cylinder 58
Tensioning head 60
Pickup 62
Electronic controls 64
Cord connection 66
Tremolo device
Keyboard overlay 70
Dampening material 71
Keys 72
overlay support 73
White keys 74
Hand contact playing area 75
Black keys 76
a key separation distance 78
pivot connection 80 spring bias 82
key stop 84
hammers 86
hammer body 88
hammer head 90
a hammer line 92
an acute angle 94
an edge 96 of the keyboard overlay From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

What is claimed is:

1. A musical instrument apparatus adapted for operation by a user, the musical instrument apparatus comprising:

a body extending between a bridge and a head, the body including a neck having an upper surface at least partially extending between the bridge and the head;

multiple parallel strings secured between the bridge and the head above the upper surface, the multiple parallel strings defining a string line;

a keyboard overlay having keys operatively connected to hammers positioned in a hammer line, wherein the hammer line is positioned at an acute angle to the string line such that each hammer is operatively positioned to contact at least one of the multiple parallel strings; and wherein the keys extend over the multiple parallel strings and the hammers are fixed underneath the keys such that the hammers and keys pivot together.

2. The apparatus of claim 1, wherein at least one hammer is adapted to cause vibration at least one of the multiple parallel strings.

3. The apparatus of claim 1, wherein the multiple parallel strings includes a first string having a first length adapted to vibrate at a first frequency and at least one hammer is adapted to clamp the first string against the upper surface to form a reduced length that vibrates at a second frequency.

4. The apparatus of claim 3, wherein the at least one hammer is further adapted to release the first clamped string.

5. The apparatus of claim 1, the multiple parallel strings extending past an edge of the keyboard overlay a sufficient distance such that the user can directly play at least one of the multiple parallel strings.

6. The apparatus of claim 1, the multiple parallel strings extending past an edge of the keyboard overlay a sufficient distance such that the user can directly strum at least one of the multiple parallel strings.

7. The apparatus of claim 1, the multiple parallel strings extending past an edge of the keyboard overlay a sufficient distance such that the user may pick at least one of the multiple parallel strings.

8. The apparatus of claim 1, the multiple parallel strings extending past an edge of the keyboard overlay a sufficient distance such that the user may pluck at least one of the multiple parallel strings.

9. The apparatus of claim 1, further comprising an electrical pickup positioned to sense vibration of at least one of the multiple parallel strings and generate an electrical signal.

10. The apparatus of claim 1, the body including a hollow resonant area adapted to provide acoustic resonance.

11. A musical instrument apparatus adapted for operation by a user, the musical instrument apparatus comprising:

multiple parallel strings spaced apart by a first distance, the multiple parallel strings secured between a bridge and a head and positioned above an upper surface, the multiple parallel strings defining a string line; and a keyboard overlay having keys spaced at a second distance that is greater than the first distance, the keys operatively connected to hammers positioned in a hammer line, wherein the hammer line is positioned at an acute angle to the string line such that each hammer is positioned to contact at least one of the multiple parallel strings; and wherein the keys extend over the multiple parallel strings and the hammers are fixed underneath the keys such that the hammers and keys pivot together.

12. The apparatus of claim 11, wherein at least one hammer is adapted to cause vibration at least one of the multiple parallel strings.

13. The apparatus of claim 1, wherein the multiple parallel strings includes a first string having a first length adapted to vibrate at a first frequency and at least one hammer is adapted to clamp the first string against the upper surface to form a reduced length that vibrates at a second frequency.

14. The apparatus of claim 13, wherein the at least one hammer is further adapted to release the first clamped string.

15. The apparatus of claim 11, the multiple parallel strings extending past an edge 96 of the keyboard overlay a sufficient distance such that the user can directly play at least one of the multiple parallel strings.

16. The apparatus of claim 11, further comprising an electrical pickup positioned to sense vibration of at least one of the multiple parallel strings and generate an electrical signal.

17. The apparatus of claim 11, the body including a hollow resonant area adapted to provide acoustic resonance.

* * * * *